US010299521B2

(12) United States Patent
Wolf et al.

(10) Patent No.: US 10,299,521 B2
(45) Date of Patent: May 28, 2019

(54) APPARATUS AND METHOD FOR MAKING AND FOLDING AN ARTICLE

(71) Applicant: Curt G. Joa, Inc., Sheboygan Falls, WI (US)

(72) Inventors: Todd M. Wolf, Sheboygan, WI (US); Jeffrey W. Fritz, Plymouth, WI (US); Jon Allen Pelland, Sheboygan, WI (US)

(73) Assignee: Curt G. Joa, Inc., Sheboygan Falls, WI (US)

( * ) Notice: Subject to any disclaimer, the term of this patent is extended or adjusted under 35 U.S.C. 154(b) by 102 days.

(21) Appl. No.: 15/672,007

(22) Filed: Aug. 8, 2017

(65) Prior Publication Data

US 2018/0035731 A1 Feb. 8, 2018

Related U.S. Application Data

(60) Provisional application No. 62/371,925, filed on Aug. 8, 2016.

(51) Int. Cl.

| | |
|---|---|
| ***A41D 13/12*** | (2006.01) |
| ***A41H 42/00*** | (2006.01) |
| ***D06F 89/02*** | (2006.01) |
| ***B65B 63/04*** | (2006.01) |
| *A41H 43/02* | (2006.01) |
| *B65B 25/20* | (2006.01) |

(52) U.S. Cl.

CPC ..... *A41D 13/1209* (2013.01); *A41H 42/00* (2013.01); *B65B 63/045* (2013.01); *D06F 89/02* (2013.01); *A41D 2300/33* (2013.01); *A41D 2400/42* (2013.01); *A41D 2400/44* (2013.01); *A41D 2500/30* (2013.01); *A41H 43/0257* (2013.01); *B65B 25/20* (2013.01)

(58) Field of Classification Search

None

See application file for complete search history.

(56) References Cited

U.S. PATENT DOCUMENTS

| | | | | |
|---|---|---|---|---|
| 3,681,785 A * | 8/1972 | Truman | ..... | A41H 42/00 156/302 |
| 3,721,999 A | 3/1973 | Goya et al. | | |
| 3,745,587 A | 7/1973 | Bradley | | |
| 3,843,971 A | 10/1974 | Delanty et al. | | |
| 5,025,501 A | 6/1991 | Dillon | | |

FOREIGN PATENT DOCUMENTS

WO WO-2010142383 A1 * 12/2010 ..... A41D 13/1209

OTHER PUBLICATIONS

International Search Report and Written Opinion pertaining to PCT/US2017/045954, dated Oct. 19, 2017, 8 pages.

* cited by examiner

*Primary Examiner* — Barbara J Musser

(74) *Attorney, Agent, or Firm* — Ziolkowski Patent Solutions Group, SC

(57) ABSTRACT

A method for manufacturing and folding a gown which increases manufacturing efficiency and consistency and decreases the time to manufacture. Additionally, the method includes folding a gown for packaging which will allow a person to don the gown with minimal contact with the outer portions of the gown.

6 Claims, 11 Drawing Sheets

| 1-1 |
|---|
| 1-2 |

| 1-1 |
|---|
| 1-2 |

2-1
2-2

2-1
2-2

4-1
4-2
6000A
6000B
6001A/6002A
6001B/6002B
600A
600B
602A
602B
6003A/6004A
6003B/6004B
620A
620B
626A
626B
670A
670B
3004A
3004B
3003A
3003B
1006/1007
2007/2008
144
244
170
270
100
200
302
3002
140
240
1004/1005
2004/2005
308
1003
2003
160
252
152
260
306
3001
304
1001
2001
150
250
320
112
212
CMD
MD
1000
2000
3000

3008
7004/
7005
700
7003
720
7002
7000
710
3006A / 3007
3006B / 3007
420
414
310
314
306
304
312
514
520
4000
420
5000
520
From Fig. 4-1
3012
3011
10
3010

APPARATUS AND METHOD FOR MAKING AND FOLDING AN ARTICLE

RELATED APPLICATIONS

This application claims the benefit of U.S. Provisional Application Ser. No. 62/371,925, filed 8 Aug. 2016.

BACKGROUND OF THE INVENTION

This invention relates to gowns worn in hygienic locations in places such as hospitals and are particularly used in surgical and medical procedures and as isolation barriers in non-surgical applications, and more particularly to a method of manufacturing the gowns and a method for folding the gowns in a way to promote sterility and ease of donning.

As depicted in U.S. Pat. No. 3,721,999 to Goya et al., it is preferable in surgical procedure applications that the gowns are folded in a way to reduce contact of a wearer with the outside of the gown during the donning process to reduce the chances for contamination. Presently, gowns such as the ones that are the subject of this patent are manufactured by hand. The art of gown manufacturing would benefit from a method of manufacture which provides more consistency from one gown to the next and increases manufacturing efficiency, while decreasing the time to manufacture and fold a gown for packaging.

SUMMARY OF THE INVENTION

The present invention relates to a gown and a method for manufacturing and folding a gown which increases manufacturing efficiency and decreases the time to manufacture. Additionally, the method includes folding a gown for packaging which will allow a person to don the gown with minimal contact with the outer portions of the gown.

In an embodiment of the invention, a nonwoven gown includes a belt, two sleeve portions, a front panel and left and right back panels. The sleeve portions of the nonwoven gown include temporary bonds between the folded portions of the sleeves and between the sleeves and the front panel that keep the sleeves in place prior to being worn. The gown is configured to have right and left back panels folded over the front, or outside surface, of the front panel, with the sleeve portions located between the front and rear panels.

The panels of the nonwoven gown may be made from separate pieces of nonwoven material, may be integral with another panel or may contain two or more components. In an embodiment, the sleeve portions are each made from two separate nonwoven sheets, corresponding to top and bottom arm regions. The sleeve portions may also include elasticated regions.

Another aspect of the invention provides a method for assembling a nonwoven gown including the steps of providing a front panel material with an outside surface, providing a right arm sleeve, providing a left arm sleeve, providing a belt, providing a left back panel material with an inside surface, and a right back panel material with and inside surface, cutting a neck hole in the front panel material; folding the right and left arm sleeves; adhering the folded right arm sleeve to the outside surface of the front panel material along a first edge portion; adhering the folded left arm sleeve to the outside surface of the front panel material along a second edge; adhering the belt to the outside surface of the front panel material; adhering the inside surface of the left back panel material to the folded left arm sleeve and the second edge portion of the outside surface of the front panel material; and adhering the inside surface of the right back panel material to the folded right arm sleeve and the first edge portion of the outside surface of the front back panel material to form a gown assembly; c-folding the gown assembly along the major dimension of the front panel material, with either the right back panel material and folded right arm sleeve substantially atop the left back panel material and the folded left arm sleeve or with the left back panel material and the folded left arm sleeve substantially atop the right back panel material and the folded right arm sleeve; cutting the gown assembly into discrete gowns; folding the gown in half a first time about the minor dimension of the front panel; and folding the gown in half a second time about the minor dimension of the front panel.

BRIEF DESCRIPTION OF THE DRAWINGS

FIG. 1-2 is part 2 of 2 of a block diagram of a preferred method for manufacturing a gown according to the present invention.

FIG. 2-1 is part 1 of 2 of a schematic of a preferred embodiment of an apparatus configured to perform the method shown in FIGS. 1-1 and 1-2.

FIG. 2-2 is part 2 of 2 of a schematic of a preferred embodiment of an apparatus configured to perform the method shown in FIGS. 1-1 and 1-2.

FIG. 4-1 is part 1 of 2 of a product flow diagram of the method provided in FIGS. 1-1 and 1-2.

FIG. 4-2 is part 2 of 2 of a product flow diagram of the method provided in FIG. 1.

DESCRIPTION OF THE PREFERRED EMBODIMENT

Although the disclosure hereof is detailed and exact to enable those skilled in the art to practice the invention, the physical embodiments herein disclosed merely exemplify the invention which may he embodied in other specific structures. While the preferred embodiment has been described, the details may be changed without departing from the invention.

Figure 1:
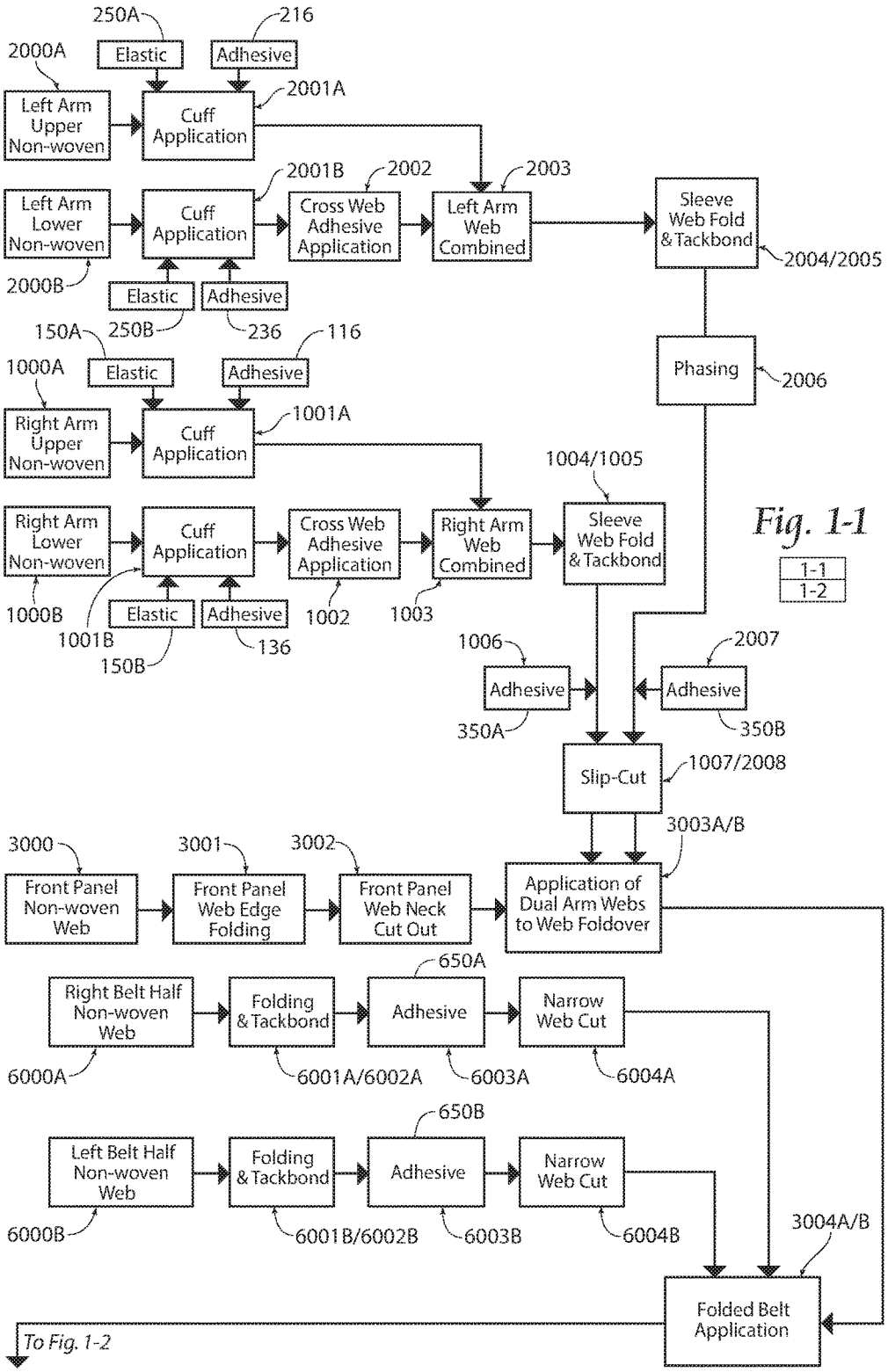
FIG. 1-1 is part 1 of 2 of a block diagram of a preferred method for manufacturing a gown according to the present invention.
Figures 1, 2:
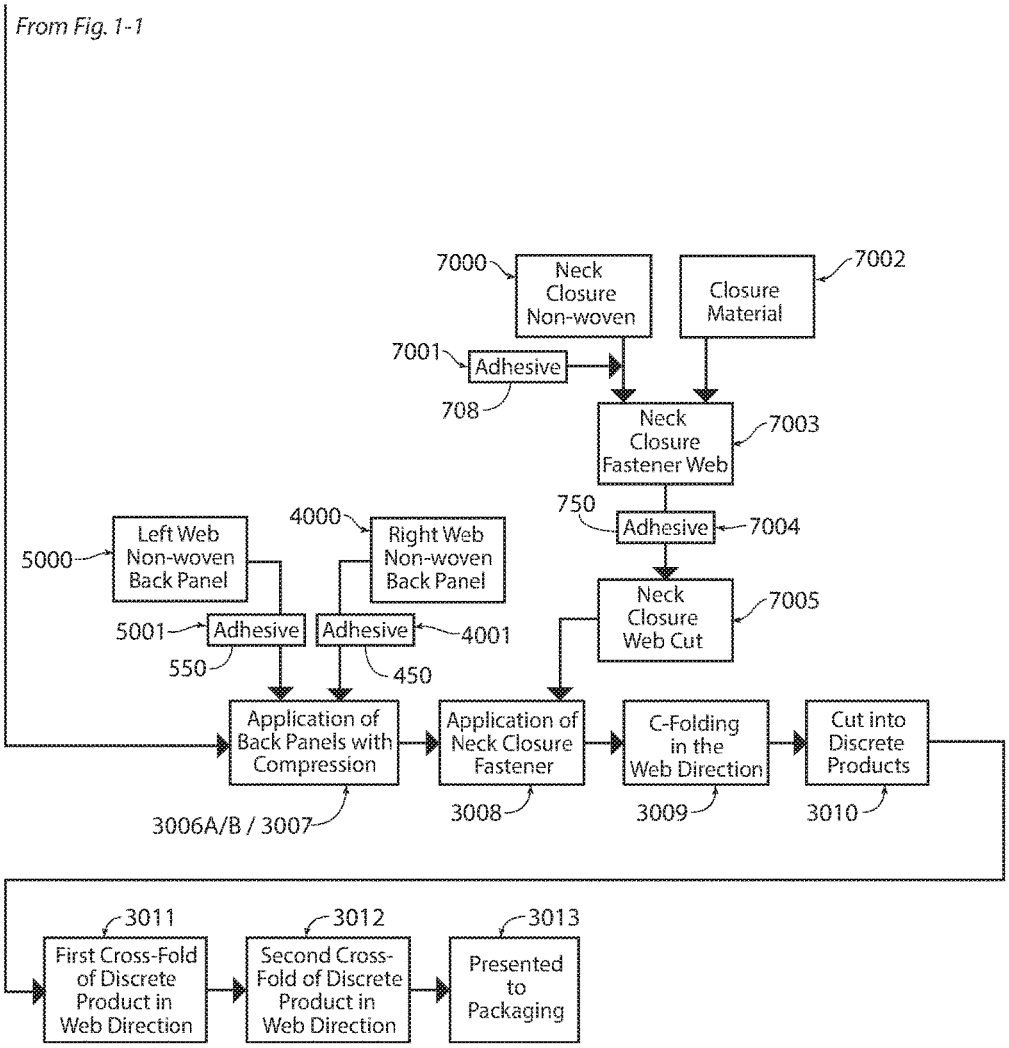
Figures 1, 2:
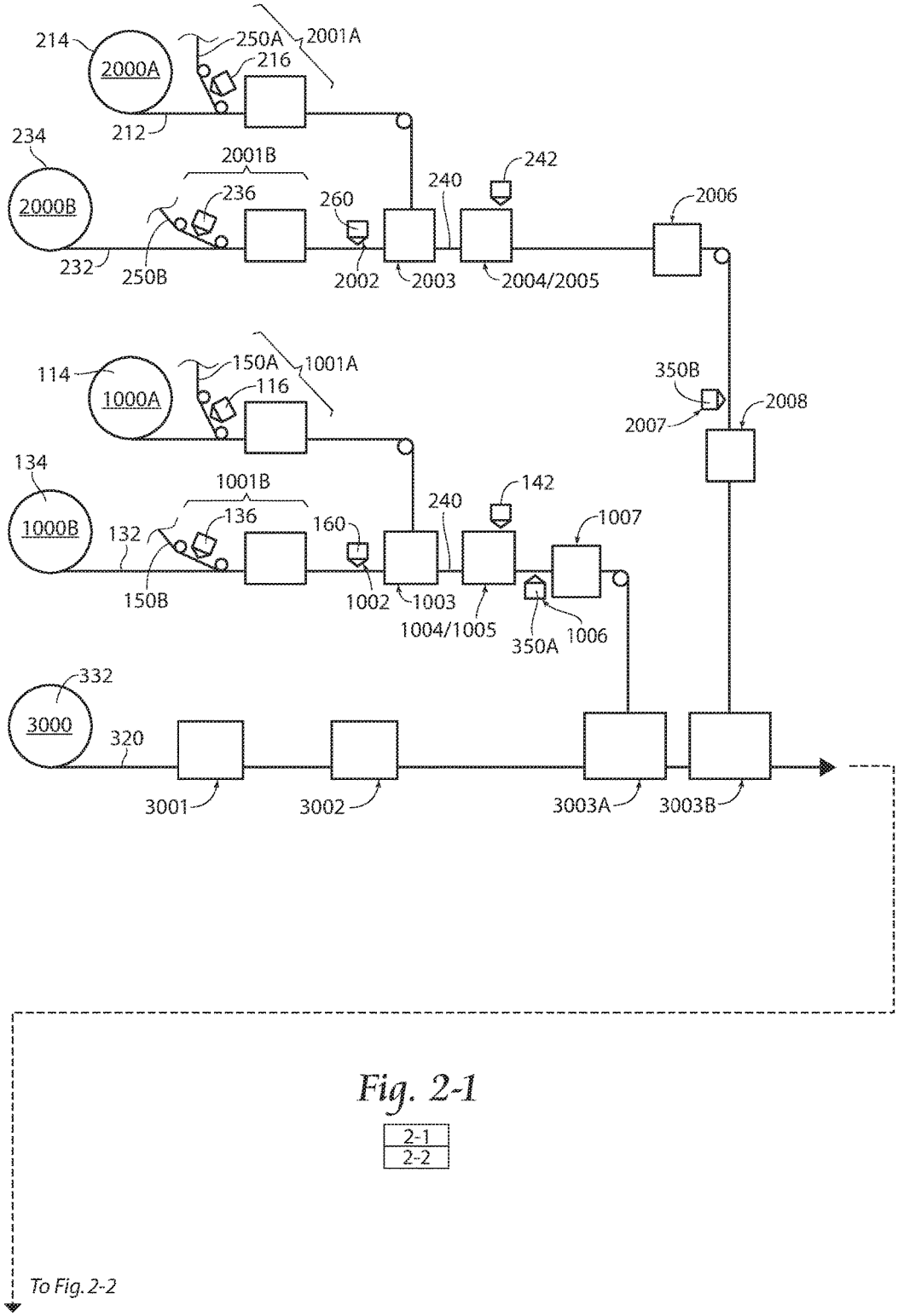
Figure 2:
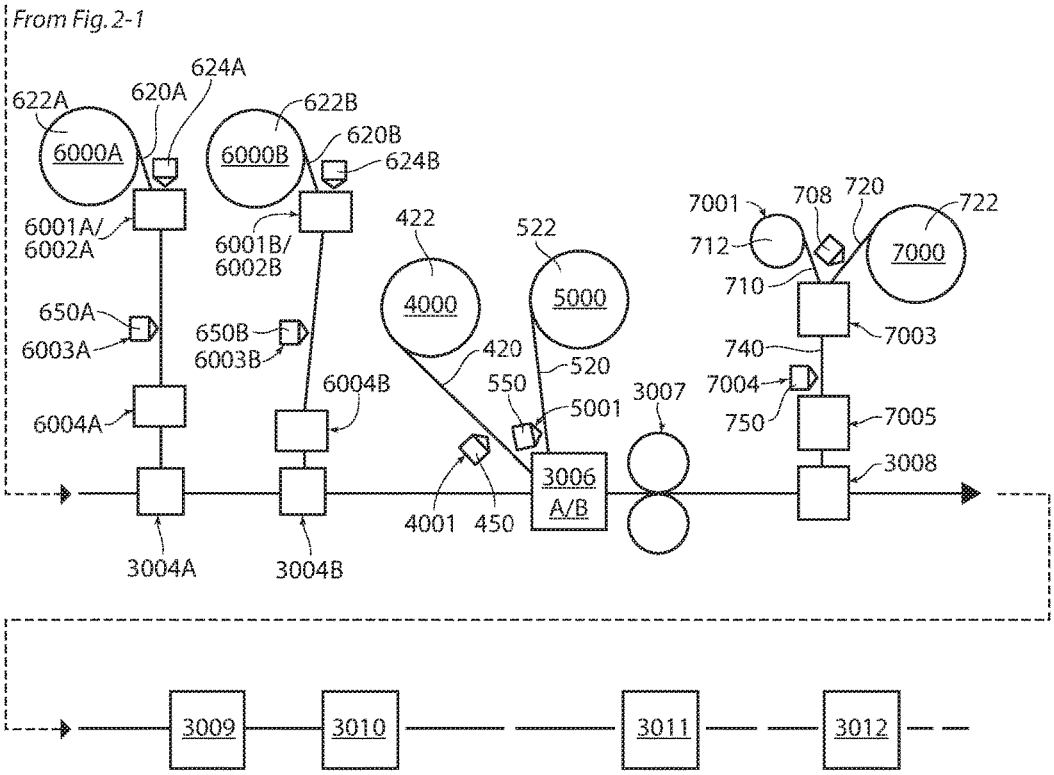

FIGS. 1-1 and 1-2 provides a block diagram showing the preferred method for forming and folding a gown 10 (see FIGS. 6 and 7) according to the present invention. The gown 10 preferably comprises a right arm sleeve 100, a left arm sleeve 200, a front panel 300, a right hack panel 400, a left hack panel 500, a belt 600, and a neck closure 700.

Figure 6:
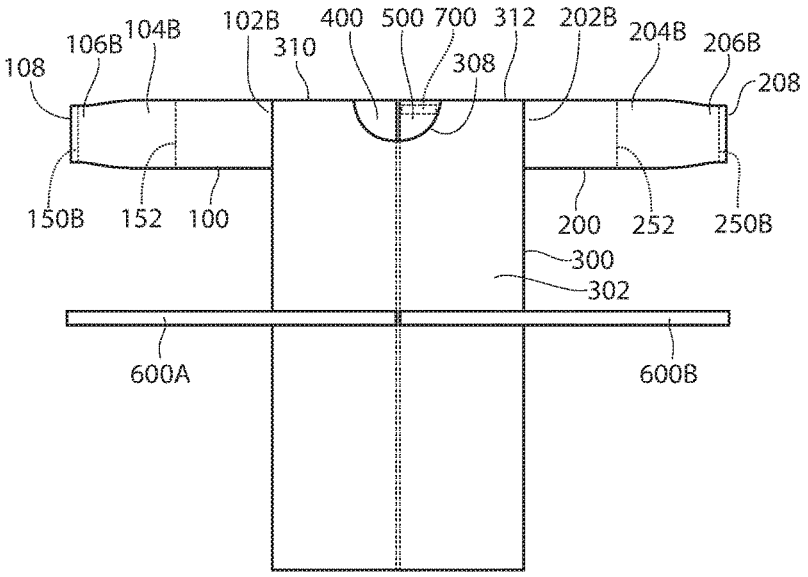
FIG. 6 is a front view of a gown according to the present invention.
Figure 7:
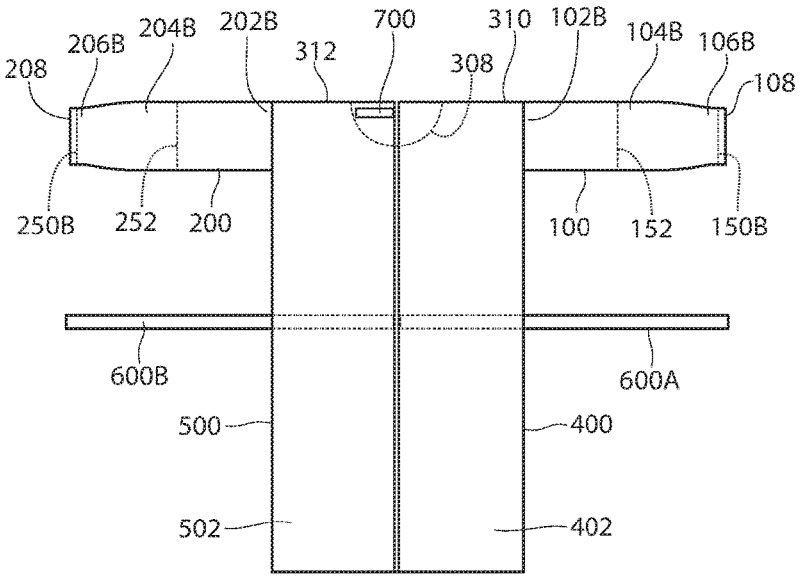
FIG. 7 is a rear view of the gown shown in FIG. 6.
Figure 8:
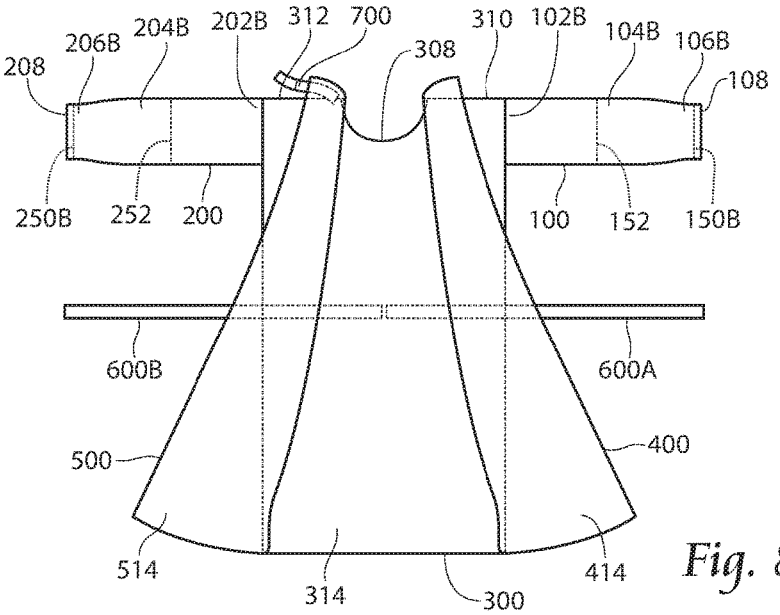
FIG. 8 is a rear view of the gown shown in FIG. 6.

Preferably, the right arm sleeve 100 comprises a right arm upper section 110 and a right arms lower section 130 which are combined to form the right arm sleeve 100. The right arm sleeve 100 has a right arm proximal end portion 102 with a right arm opening 164, a right arm medial portion 104, and a right arm distal end portion 106, preferably with a right arm cuff 108 as shown in FIGS. 6 and 7. Elastic 150 is preferably provided at the right arm distal end portion 106 in the cuff 108 and optionally elastic 152 at the right arm medial portion 104 (see FIGS. 3 and 3A) to encourage a close fit to the arm of a user 20 (see FIGS. 9-14).

Similarly, the left arm sleeve 200 comprises a left arm upper section 210 and a left arm lower section 230 which are combined to form the left arm sleeve 200. The left arm sleeve 200 has a left arm proximal end portion 202 with a left arm opening 264, a left arm medial portion 204, and a left arm distal end portion 206 with a left arm cuff 208 as shown in FIGS. 6 and 7. Elastic 250 is preferably provided at the left arm distal end portion 206 in the cuff 208 and optionally elastic 252 at the left arm medial portion 204 (see FIGS. 3 and 3A) to encourage a close fit to the arm of a user 20 (see FIGS. 9-14).

The front panel 300 comprises a front panel outside surface 302 and a front panel inside surface 314, the right back panel 400 comprises a right back panel outside surface 402 and a right back panel inside surface 414, and the left back panel 500 comprises a left back panel 502 outside surface and a left back panel inside surface. The front panel 300, the right back panel 400, and the left back panel 500 are preferably substantially rectangular in shape, each having a major dimension and a minor dimension. It should be understood that reference to inside and outside surfaces relate to the location of those surfaces when the gown 10 is worn.

The belt 600, as illustrated most clearly in FIG. 6, preferably comprises a strip of nonwoven material and has a right belt half 600A and a left belt half 600B.

Figures 1, 4, 4A, 4B, 4C, 4D:
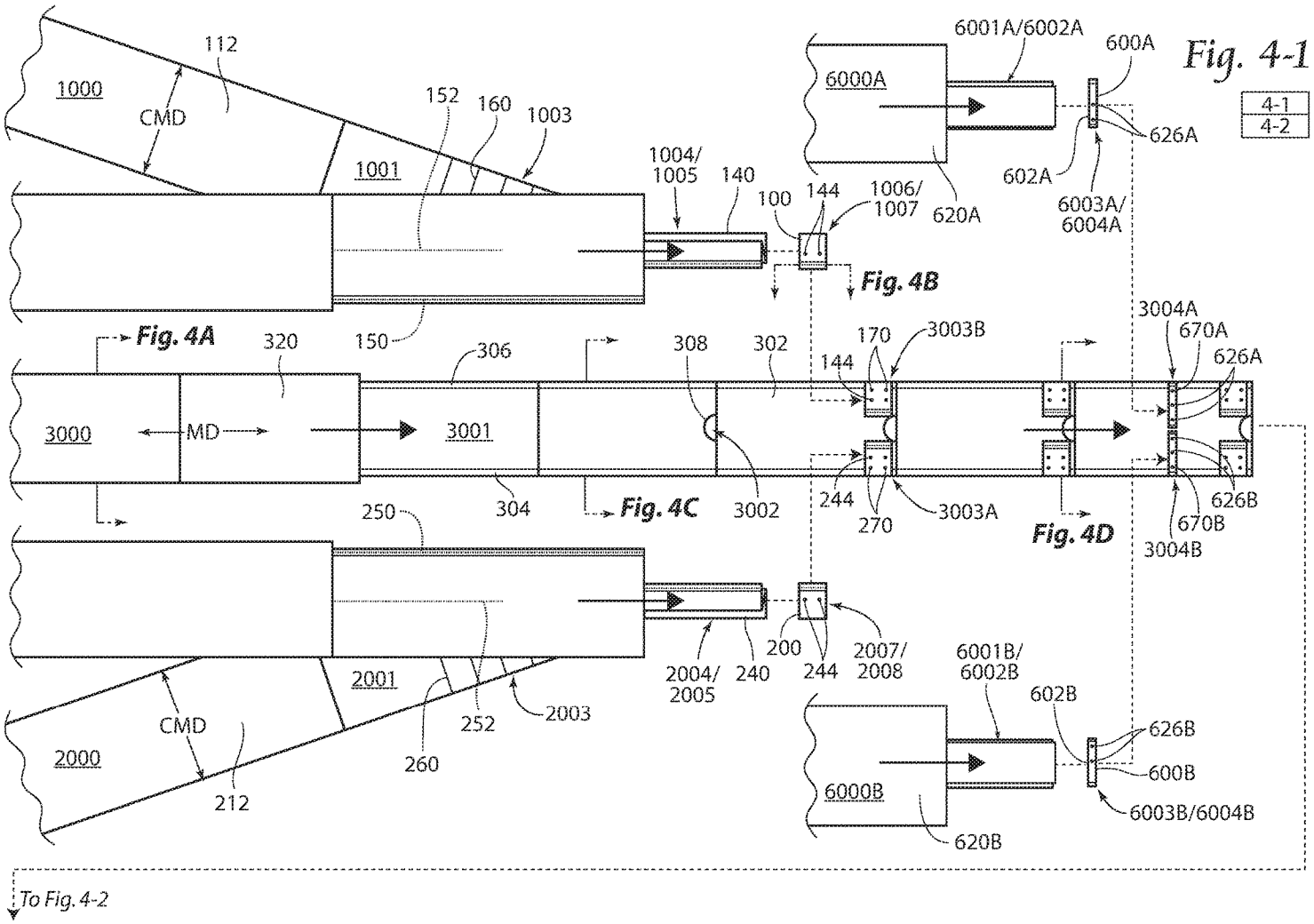
Figures 2, 4, 4E, 4F, 4G:
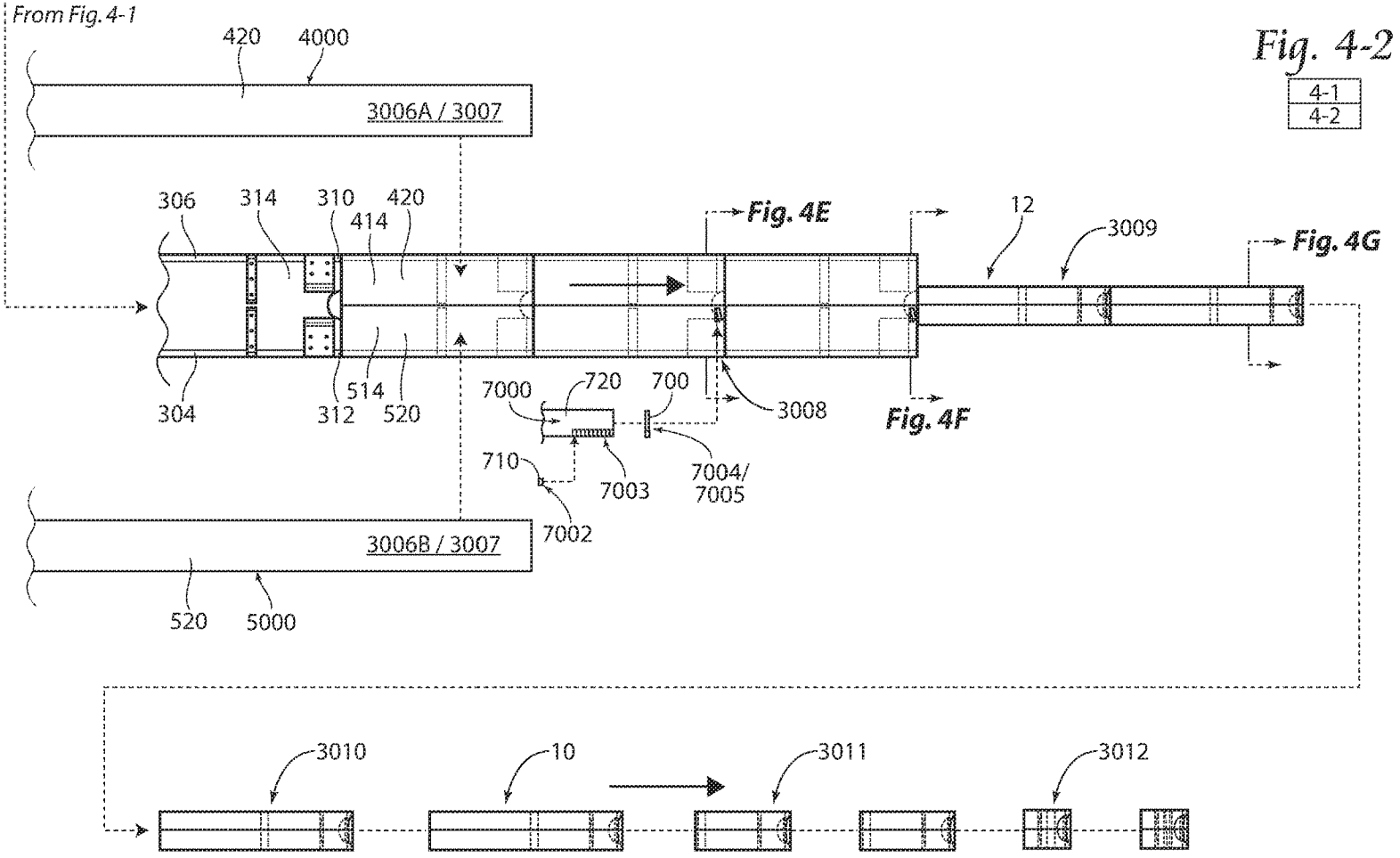
Figure 4A:
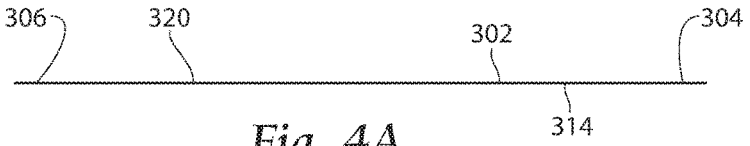
FIG. 4A is a cross-sectional view taken along lines 4A-4A in FIG. 4-1.
Figure 4B:
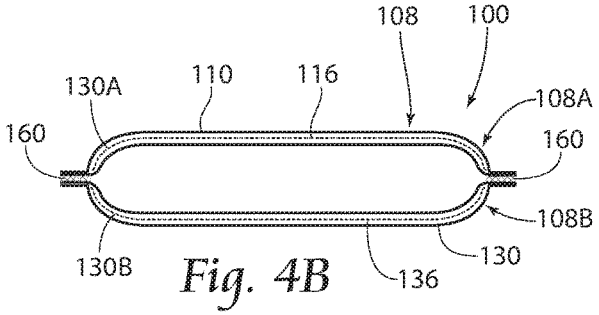
FIG. 4B is a cross-sectional view taken along lines 4B-4B in FIG. 4-1.
Figure 4C:
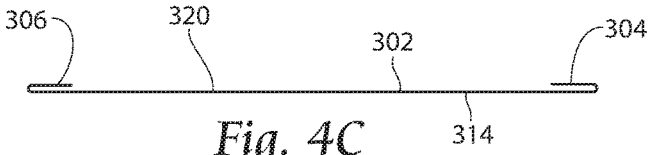
FIG. 4C is a cross-sectional view taken along lines 4C-4C in FIG. 4-1.
Figure 4D:
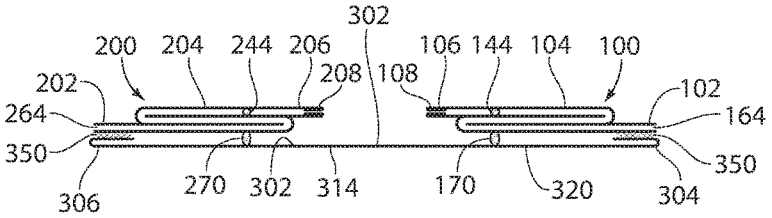
FIG. 4D is a cross-sectional view taken along lines 4D-4D in FIG. 4-1.
Figure 4E:
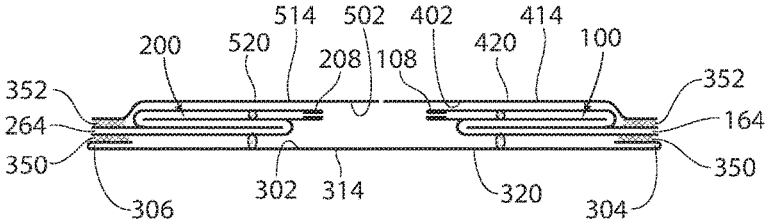
FIG. 4E is a cross-sectional view taken along lines 4E-4E in FIG. 4-2.
Figure 4F:
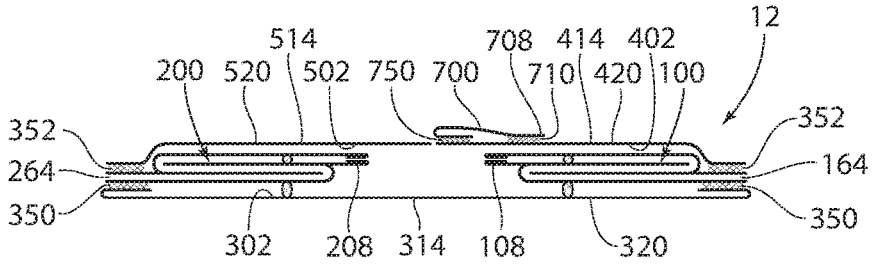
FIG. 4F is a cross-sectional view taken along lines 4F-4F in FIG. 4-2.
Figure 4G:
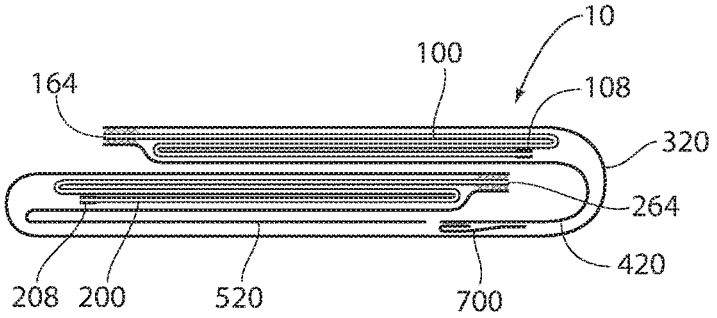
FIG. 4G is a cross-sectional view taken along lines 4G-4G in FIG. 4-2.

The neck closure 700, as shown in FIGS. 4F and 7, comprises a strap 702 having a first end portion 704, a second end portion 706, and a closure or hook material 710 adhered to the second end portion 706 with adhesive 708. The first end portion 704 is attached to the left back panel 500 with adhesive 750 and the second end portion 706 is configured to engage with the nonwoven material of the right back panel 400. This illustrates one preferred embodiment of a neck closure 700 and should not be construed as limiting in orientation or design. For example, additionally or alternatively, the neck closure 700 may comprise a tie material (not shown) attached to each of the right back panel 400 and the left back panel 500 and configured to be tied together.

The method according to the preferred embodiment is performed in a series of simultaneous and sequential routines as depicted. in FIGS. 1-1, 1-2, 2-1, 2-2, 4-1, and 4-2.

Looking first to the sleeve forming operation shown in FIGS. 1-1, 2-1, and 4-1. It can be seen that a nonwoven material 112 for the right arm upper section 110 is dispensed from a roll 114 (Step 1000A). The nonwoven. material 112, as well as all other nonwoven material discussed herein, may be a nonwoven web including substantially continuous polymeric fibers or filaments. In an exemplary embodiment, the nonwoven material 112 is a 20-30 gsm spunbond-meltblown-spunbond composite ("SMS") web. The nonwoven material 112 may include a surface treatment to provide additional properties such as providing alcohol repellency and/or antistatic properties. For example, a gown. for use as an isolation gown may be made from a 20-30 gsm SMS with antistatic properties. In another example, a gown for use as a surgical gown may also be made alcohol repellent through fluorochemical treatment. Alternatively, a gown for industrial purposes, such as handling chemical spills may be made from a heavier nonwoven and may have additional treatments.

Nonwoven material used in different panels of the gown 10 as discussed further below may be the same throughout or may differ. For example, in areas, such as sleeves in surgical gowns, a thicker nonwoven may be used or the nonwoven may include a laminated film layer.

Preferably, at least one elastic band 150A is preferably adhered along the distal end portion 106A of the right arm upper section nonwoven material 112 in the machine direction MD with an adhesive 116, and the distal end portion 106A is folded as is known in the art to form a right arm upper section cuff 108A (Step 1001A). Additionally or alternatively, securing apparatus (not shown) including, but not limited to, ties, strings, heat shrinkable material, etc. are contemplated to be included within or near the cuff 108A.

Optionally, an elastic band 152A is adhered to the right arm upper section nonwoven material 112 along the medial portion 104A in the machine direction MD with an adhesive (not shown).

Substantially simultaneously, a nonwoven material 132 for the right arm lower section 132 is dispensed from a roll 134 (Step 1000B). Preferably, at least one elastic band 150B is adhered along the distal end portion 106B of the right arm lower section nonwoven material 132 in the machine direction MD with an adhesive 136, and the distal end portion 106B is folded as is known in the art to form a right arm lower section cuff 108B (Step 1001B). Additionally or alternatively, securing apparatus (not shown) including, but not limited to, ties, strings, heat shrinkable material, etc. are contemplated to be included within or near the cuff 108B.

Optionally, an elastic band 152B is adhered to the right arm lower section nonwoven material 132 along the medial portion 104BB in the machine direction MD with an adhesive (not shown).

Figure 3:
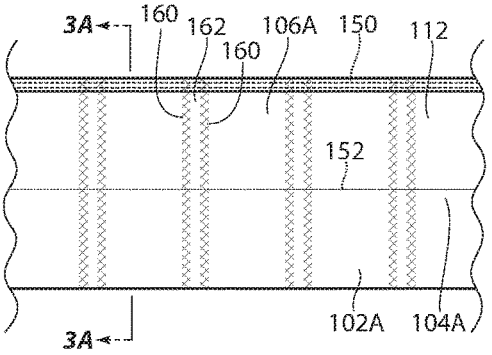
FIG. 3 is a top plan view of an arm web assembly according to the present invention.
Figure 3A:
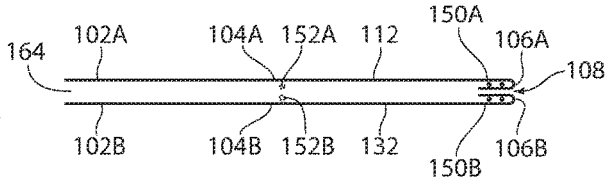
FIG. 3A is a cross-sectional view taken along lines 3A-3A in FIG. 3.

An adhesive 160 is applied to at least one of the right arm upper section nonwoven material 112 and the right arm lower section nonwoven material 132 in the cross-machine direction CMD. As shown in FIGS. 1-1, 2-1, and 3, the adhesive 160 is applied to the right arm lower section nonwoven material 132 from the right arm lower section proximal end 102B through the right arm lower section distal end 106B, preferably in a pattern as shown in FIG. 3 in which an area 162 between pairs of adhesive applications 160 provides demarcation between adjacent right arm lower sections 130 (Step 1002).

The right arm upper section nonwoven material 112 is placed atop the right arm lower section nonwoven material 132 and thereby adhered to each other by the adhesive 160 (Step 1003), forming a right arm web 140. See also FIG. 4B for a cross-sectional view of the right arm sleeve cuff 108.

The right arm web 140 is preferably folded in a manner shown in FIG. 4D, wherein the proximal portions 102A, 102B and the distal portions 106A, 106B extend beyond the folded medial portions 104A, 104B (Step 1004).

The right arm web 140 is preferably bonded with adhesive 142 (Step 1005), or any other known method including those provided below, forming at least one bond site 144, at the time when or briefly after the right arm web 140 is folded to reduce the probability that the fold will come undone during the remainder of the gown forming process. Bonding may be performed through any known method in the art including, but not limited to, tack-bonding, mechanical bonding, and ultrasonic bonding (see FIGS. 4-1 and 4D). The bond sites 144, and other bond sites described herein, are depicted in the figures for illustrative purposes. Their locations as shown in the figures should not be construed as limiting.

Adhesive 350A is applied to the right, arm proximal end portion 102 on either the right arm upper section 110 or the right arm lower section 130 (Step 1006). The right arm web 140 is slip-cut within the area 162 between the pairs of adhesive applications 160 as shown in FIG. 3 to form discrete right arm sleeves 100 (Step 1007). The, resulting discrete right arm sleeves 100 have a substantially rectangular profile. The right arm sleeves 100 are then ready to be applied to the front panel nonwoven material 320.

The left arm sleeves 200 are formed in the same manner, preferably substantially simultaneously with the formation of the right arm sleeves 100. A nonwoven material 212 for the left arm upper section 210 is dispensed from a roll 214 (Step 2000A). Preferably, at least one elastic band 250A is adhered along the distal end portion 206A of the left arm upper section nonwoven material 212 in the machine direction MD with an adhesive 216, and the distal end portion 206A is folded as is known in the art to form a left arm upper section cuff 208A (Step 2001A). Additionally or alternatively, securing apparatus (not shown) including, but not limited to, ties, strings, heat shrinkable material, etc. are contemplated to be included within or near the cuff 208A.

Optionally, an elastic hand 252A is adhered to the left arm upper section nonwoven material 212 along the medial portion 204A in the machine direction MD with an adhesive (not shown).

Substantially simultaneously, a nonwoven material 232 for a left arm lower section 230 is dispensed from a roll 234 (Step 2000B). Preferably, at least one elastic band 250B is adhered along the distal end portion 206B of the left arm lower section nonwoven material 232 in the machine direction MD with an adhesive 236, and the distal end portion 206B is folded as is known in the art to form a left arm lower section cuff 208B (Step 2001B). Additionally or alternatively, securing apparatus (not shown) including, but not limited to, ties, strings, heat shrinkable material, etc. are contemplated to be included within or near the cuff 208B.

Optionally, an elastic hand 252B is adhered to the left arm lower section nonwoven material 232 along the medial portion 204B in the machine direction MD with an adhesive (not shown).

An adhesive 260 is applied to at least one of the left arm upper section nonwoven material 212 and the left arm lower section nonwoven material 232 in the cross-machine direction CMD. As shown in FIGS. 1-1 and 2-2, the adhesive 260 is applied to the left arm lower section nonwoven material 232 from the left, arm lower section proximal end 202B through the left arm lower section distal end 206B similar to the adhesive 160 application to the right arm lower section nonwoven material 132 discussed above and preferably in a pattern as shown in FIG. 3 in which an area 262 between pairs of adhesive applications 260 provides demarcation between adjacent left arm lower sections 230 (Step 2002).

The left arm upper section nonwoven material 212 is placed atop the left arm lower section nonwoven. material 232 and adhered to each other by the adhesive 260 (Step 2003), forming a left arm web 240.

The left arm web 240 is preferably folded in a manner shown in FIG. 4D wherein the proximal portions 202A, 202B and the distal portions 206A, 206B extend beyond the folded medial portions 204A, 204B (Step 2004).

The left arm, web 240 is preferably bonded with. adhesive 242 (Step 2005), or any other known method including those provided below, forming at least one bond site 244, at the time when or briefly after the left arm web 240 is folded, to reduce the probability that the fold will come undone during the remainder of the gown forming process. Bonding may be performed through any known method in the art including, but not limited to, tack-bonding, mechanical bonding, and ultrasonic bonding (see FIGS. 4-1 and 4D).

The left arm sleeve 200 is preferably phased with the right arm sleeve 100 (Step 2006) to ensure proper alignment with the right arm sleeve 100 upon application of the left arm sleeve 200 onto the front panel nonwoven material 320. It should be understood that, alternatively, the right arm sleeve 100 could he phased with respect to the left arm sleeve 200.

Adhesive 350B is applied to the left arm proximal end portion 202 on either the left arm upper section 210 or the left arm lower section 230 (Step 2007). The left arm web 240 is slip-cut, within the area. 262 between the pairs of adhesive applications 260 as shown in FIG. 3 to form discrete left arm sleeves 200 (Step 2008). The resulting discrete left arm sleeves 200 have a substantially rectangular profile. The left arm sleeves 200 are then ready to be applied to the front panel nonwoven material 320.

Preferably, as the right and left arm sleeves 100,200 are being formed, a nonwoven material 320 for the front panel 300 is dispensed from a roll 322 in an orientation in which the out side surface 302 (see FIGS. 4-1 and 4A) of the front panel 300 is face-up, with the major dimension of the front panel 300 oriented in-line with the machine direction MD and the minor dimension of the front panel 300 oriented in-line with the cross-machine direction CMD (Step 3000).

The front panel nonwoven material 320 is preferably folded along first and second edge portions 304,306 upward and inward as shown in FIG. 4C (Step 3001), and a neck opening 308 is preferably cut out of the front panel nonwoven material 320 as shown in FIG. 4-1 (Step 3002). It should be known that Step 3002 may occur at any point along the process up to the point at which the right and left pack panels 400,500 are applied (see Step 3007 below).

The right arm sleeve 100 is applied to the front panel nonwoven material 320 by adhering the right arm proximal end portion 102 to the folded first edge portion 304 near the neck opening 308 (Step 3003A). The right arm cuff 108 is preferably positioned at the top of the folded right arm sleeve 100 and inward from the folded first edge portion 304 as shown in FIGS. 4-1 and 4D.

The right arm sleeve 100 may also be bonded to the front panel nonwoven material 320 in a manner similar to the bonding of the folds of the right arm web 140 discussed above (i.e., bonding may be performed through any known method in the art including, but not limited to, tack-bonding, mechanical bonding, and ultrasonic bonding (see FIG. 4-1).

Substantially simultaneously with the application of the right arm sleeve 100, the left arm sleeve 200 is applied to the front panel nonwoven material 320 by adhering the left arm proximal end portion 202 to the folded second edge portion 306 near the neck opening 308 and opposite trio right arm sleeve 100 (Step 3003B). The left arm cuff 208 is preferably positioned at the top of the folded left arm sleeve 200 and inward from the folded second edge portion 306 as depicted in FIGS. 4-1 and 4D.

The left arm sleeve 200 may also be bonded to the front panel nonwoven material 320 in a manner similar to the bonding of the folds of the left arm web 240 discussed above (i.e., bonding may be performed through any known method in the art including, but not limited to, Lack-bonding, mechanical bonding, and ultrasonic bonding (see FIG. 4-1).

The belt 600 comprises nonwoven material 620 and is preferably formed from, a right and a left belt half 600A, 600B. The nonwoven material 620A for the right belt half 600A is dispensed from a roll 622A (Step 6000A) and folded in a z-pattern as illustrated in FIG. 4-1 (Step 6001A). The folded right belt half nonwoven material 620A is preferably bonded with adhesive 624A (Step 6002A), or any other known method including those provided below, forming at least one bond site 626A, at the time when or briefly after the right belt half nonwoven material 620A is folded to reduce the probability that the fold will come undone during the remainder of the gown forming process. Bonding may be performed through any known method in the art including, but not limited to, tack-bonding, mechanical bonding, and ultrasonic bonding.

Adhesive 650A is applied to a portion of the right belt half nonwoven material 620A that is to be adhered to the front panel nonwoven material 320 (Step 6003A). The folded right belt half nonwoven material 620A is then slip-cut into discrete folded right belt halves 600A (Step 6004A), The right belt half 600A is applied to the front panel nonwoven material 320 as shown in FIG. 4-1 (Step 3004A).

The right belt halves 600A may also be bonded to the front panel nonwoven material 320 in a mariner similar to the bonding of the folds of the right belt half nonwoven material 620A discussed above (i.e., bonding may be performed through any known method in the art including, but not limited to, tack-bonding, mechanical bonding, and ultrasonic bonding. Thereby forming at least one bond site 670A (see FIG. 4-1).

The nonwoven material 620B for the left belt half 600B is dispensed from a roll 622B (Step 6000B) and folded in a z-pattern as illustrated in FIG. 4-1 (Step 6001B). The folded left bel half nonwoven material 620B is preferably bonded with adhesive 624B (Step 6002B), or any other known method including those provided below, forming at least one bond site 626B, at the time when or briefly after the left belt half nonwoven material 620B is folded to reduce the probability that the fold will come undone during the remainder of the gown forming process. Bonding may be performed through any known method in the art including, but not limited to, tack-bonding, mechanical bonding, and ultrasonic bonding.

Adhesive 650B is applied to a portion of the left belt half nonwoven material 620B that is to be adhered to the front panel nonwoven material 320 (Step 6003B). The folded left belt half nonwoven material 620B is then slip-cut into discrete folded left belt halves 600B (Step 6004B). The left belt half 600B is applied to the front panel nonwoven material 320 as shown if FIG. 4-1 (Step 3004B).

The left belt halves 600B may also be bonded to the front panel nonwoven material 320 in a manner similar to the bonding of the folds of the left belt half nonwoven material 620B discussed above (i.e., bonding may be performed through any known method in the art including, but not limited to, tack-bonding, mechanical bonding, and ultrasonic bonding. Thereby forming at least one bond site 670B (see FIG. 4-1).

If needed or desired, either the right belt half 600A or the left belt half 600B may be phased to align with the other belt half.

The right and left back panels 400,500 are preferably formed from nonwoven material 420,520 dispensed from rolls 422,522, respectively (Steps 4000/5000). Alternatively, the nonwoven materials 420,520 may be formed from one roll of nonwoven (not shown) that is split to form the two individual right and left back panel nonwoven materials 420,520.

An adhesive 450 is applied to the outside surface 402 of the right back panel nonwoven material 420 in a location corresponding to the folded first edge portion 304 and along at least a portion of the outside surface 402 of the right back panel nonwoven material 420 in a location corresponding to the right shoulder area 310 of the front panel 300 (Step 4001). The right shoulder area 310 defined as being the area on the right side of the neck opening 308 and extending from the neck opening 308 through the first edge portion 304 in the cross-machine direction CMD.

Substantially simultaneously, an adhesive 550 is applied to the outside surface 502 of the left back panel nonwoven material 520 in a location corresponding to the folded second edge portion 306 and along at least a portion of the outside surface 502 of the left back panel nonwoven material 520 in a location corresponding to the left shoulder area 312 of the front panel 300 (Step 5001). The left shoulder area 312 defined as being the area on the left side of the neck opening 308 and extending from the neck opening 308 through the second edge portion 306 in the cross-machine direction CMD.

The right and left back panel nonwoven materials 420,520 are then applied (Steps 3006A/B) with the inside surfaces 414,514 face-up and pressed (Step 3007) to the front panel nonwoven material 320 as illustrated in FIGS. 4-2 and 4E (Steps 3007A/B).

The neck closure 700 comprises a neck closure nonwoven material 720 and, depending on the type of neck closure 700, a closure material or hook material 710 as is known in the art. As depicted in FIGS. 1-2 and 2-2, the nonwoven material 720 is dispensed from a source 722 (Step 7000). Preferably, adhesive 708 is applied to the neck closure nonwoven 720 (Step 7002). Substantially concurrently, the closure material 710 is provided from a source 712 (Step 7002). The closure material 710 is applied to the neck closure nonwoven material 720 to form a neck closure web 740 (Step 7003).

Adhesive 750 is applied to the neck closure nonwoven material 720 (Step 7004) and the neck closure web 740 is slip-cut, to provide discrete neck closures 700 (Step 7005). The neck closure 700 is preferably adhered to the inside surface 414,514 of at least one of the right and left back panel nonwoven materials 420,520 near the neck opening 308 in the front panel nonwoven. material 320 as shown in FIGS. 4-2 and 4E (Step 3008). Non-limiting examples of types of adhesion include ultrasonic bonding and mechanical bonding The combined gown assembly 12 of right and left arm sleeves 100,200; front panel nonwoven material 320; right and left back panel nonwoven materials 420,520; belt 600; and neck closure 700 is C-folded as depicted in FIGS. 4-2 and 4F along the major dimension of the front panel nonwoven material 320 (Step 3009) and then the gown assembly 12 is cut into discrete assemblies to form a gown 10 according to the present invention (Step 3010).

Figure 5:
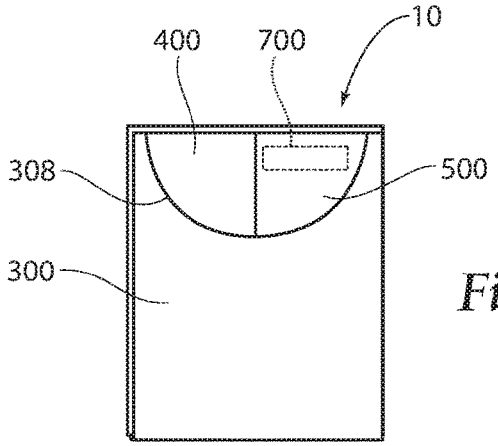
FIG. 5 is a view of a gown folded according to the present invention.

Each gown 10 is then preferably folded in half a first time along the minor dimension of the front panel 300 (Step 3011) and folded in half a second time along the minor dimension of the front panel 300 (Step 3012) as shown in FIG. 4-2. The gown 10 is then presented for packaging (Step 3013) as shown in FIG. 5.

Depending on the environment the gown 10 is to be used, an optional step of autoclaving/sterilizing (not shown) may be performed.

Figure 9:
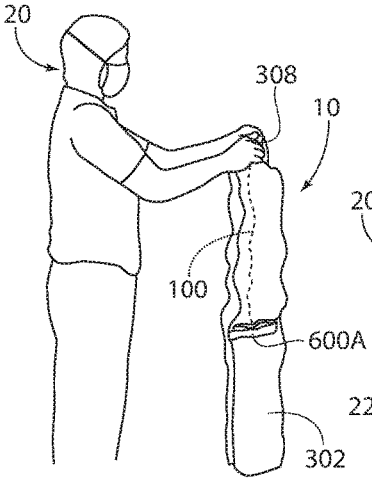
FIG. 9 is a side view of a user donning the gown shown in FIG. 6 according to the present invention.

Looking now to FIGS. 9-14, a method for donning the gown 10 is shown. FIG. 9 illustrates a user 20 preferably gripping the gown 10 at the neck opening 308 and allowing the gown 10 to unfold towards the ground (not shown); some gentle shaking may be required.

Figure 10:
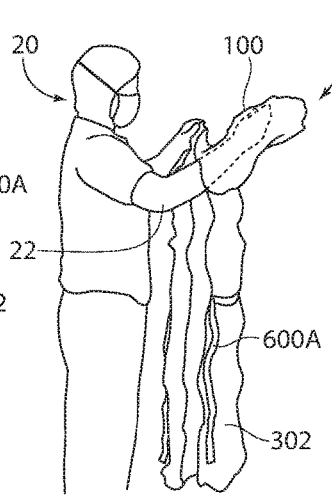
FIG. 10 is a side view of a user donning the gown shown in FIG. 6 according to the present invention.
Figure 11:
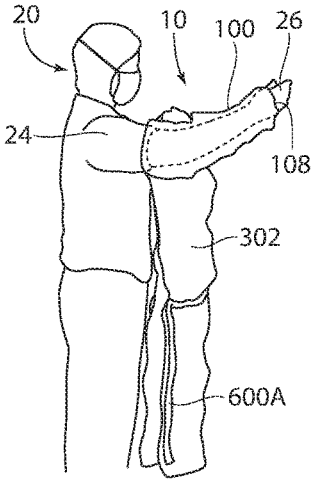
FIG. 11 is a side view of a user donning the gown shown in FIG. 6 according to the present invention.

With the inside surface 214 of the front panel 300 facing the user 20, the user 20 puts a first arm 22 into either the right arm sleeve 100 or the left arm sleeve 200. As shown in FIG. 10, the user 20 has elected to place his first arm 22 through the right arm sleeve 100. The user 20 pulls the right arm sleeve 100 to the user's first shoulder 24, pushing the user's first hand 26 through the cuff 108 as depicted in FIG. 11.

Figure 12:
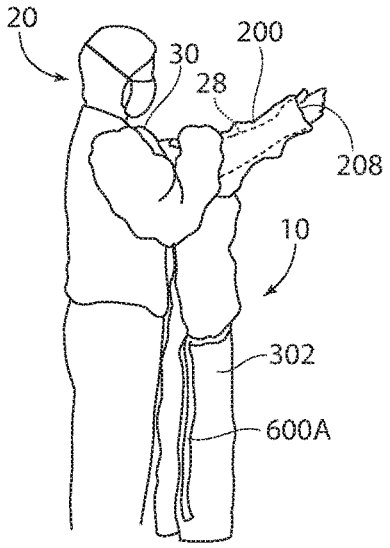
FIG. 12 is a side view of a user donning the gown shown in FIG. 6 according to the present invention.

The same procedure is performed for the user's second arm 28. Putting the second arm into the other sleeve, here the left arm sleeve 200, pulling the left arm sleeve 200 to the user's second shoulder 30, and pushing the user's second hand 32 through the cuff 208 as shown in FIG. 12.

Figure 13:
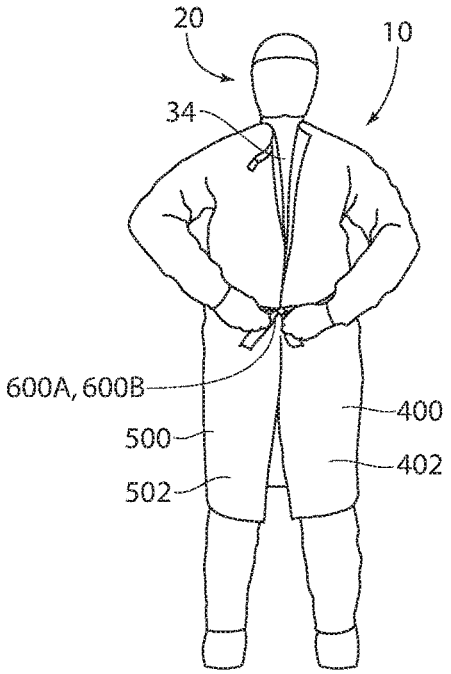
FIG. 13 is a rear view of a user donning the gown shown in FIG. 6 according to the present invention.
Figure 14:
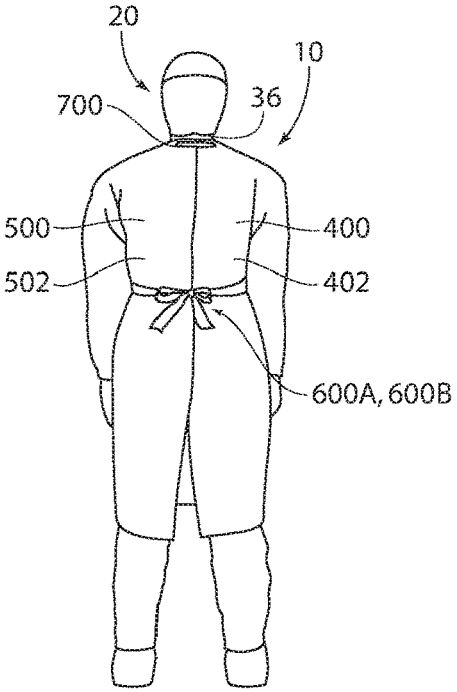
FIG. 14 is a rear view of a user donning the gown shown in FIG. 6 according to the present invention.

In FIG. 13, the user 20 has positioned the inside surfaces 414,514 of the right and left back panels 400,500 adjacent to the back 34 of the user 20 and the user 20 is illustrated tying the right belt half 600A and the left belt half 600B together behind the user's back 34 to secure the gown 10 tightly to the user 20. In FIG. 14, the user 20 is depicted securing the neck closure 700 to draw the right and left back panels 400,500 together at the user's neck 36.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention which is defined by the claims.

We claim:

1. A method for forming a nonwoven gown assembly including the steps of:

providing a front panel material having an outside surface;

providing a right arm sleeve;

providing a left arm sleeve;

providing a left back panel material having an inside surface;

providing a right back panel material having an inside surface;

cutting a neck bole in the front panel material;

folding the right arm sleeve;

folding the left arm sleeve;

adhering the folded right arm sleeve to the outside surface of the front panel material along a first edge portion;

adhering the folded left arm sleeve to the outside surface of the front panel material along a second edge portion;

adhering the inside surface of the left back panel material to the folded left arm sleeve and the second edge portion of the outside surface of the front panel material; and adhering the inside surface of the right back panel material to the folded right arm sleeve and the first edge portion of the outside surface of the front back panel material.

2. The method of claim 1 including the further steps of:

providing a belt; and adhering the belt to the outside surface of the front panel material.

3. A method for forming a nonwoven gown including the steps of:

providing a gown assembly, the gown assembly including a front panel material having an outside surface, a major dimension and a minor dimension; a folded right arm sleeve; a folded left arm sleeve; a left back panel material having an inside surface; a right back panel material having an inside surface;

adhering the folded right arm sleeve to the outside surface of the front panel material along a first edge portion;

adhering the folded left arm sleeve to the outside surface of the front panel material along a second edge portion;

adhering the inside surface of the left back panel material to the folded left arm sleeve and the second edge portion of the outside surface of the front panel material;

adhering the inside surface of the right back panel material to the folded right arm sleeve and the first edge portion of the outside surface of the front back panel material;

c-folding the gown assembly along the major dimension of the front panel material, with at least one of the right back panel material and folded right arm sleeve adjacent the left back panel material and the folded left arm sleeve and the left back panel material and the folded left arm sleeve adjacent the right back panel material and the folded right arm sleeve;

cutting the gown assembly into discrete gowns;

folding a discrete gown in half a first time about the minor dimension of the front panel; and folding the discrete gown in half a second time about the minor dimension of the front panel.

4. The method of claim 3 including the further step of providing a belt.

5. A method for forming a nonwoven gown including the steps of:

providing a front panel material having an outside surface, a major dimension and a minor dimension;

providing a right arm sleeve;

providing a left arm sleeve;

providing a left back panel material having an inside surface;

providing a right hack panel material having an inside surface;

cutting a neck hole in the front panel material;

folding the right arm sleeve;

folding the left arm sleeve;

adhering the folded right arm sleeve to the outside surface of the front panel material along a first edge portion;

adhering the folded left arm sleeve to the outside surface of the front panel material along a second edge portion;

adhering the inside surface of the left back panel material to the folded left arm sleeve and the second edge portion of the outside surface of the front panel material;

adhering the inside surface of the right back panel material to the folded right arm sleeve and the first edge portion of the outside surface of the front back panel material;

c-folding the front panel material along the major dimension of the front panel material, with at least one of the right back panel material and folded right arm sleeve adjacent the left back panel material and the folded left arm sleeve and the left back panel material and the folded left arm sleeve adjacent the right back panel material and the folded right arm sleeve;

folding a discrete gown in half a first time about the minor dimension of the front panel; and folding the discrete gown in half a second time about the minor dimension of the front panel.

6. The method of claim 5 including the further step of providing a belt.

* * * * *